US006308880B1

(12) United States Patent
Ronconi

(10) Patent No.: US 6,308,880 B1
(45) **Date of Patent: *Oct. 30, 2001**

(54) COMPRESSED-AIR NAIL FIRING TOOL

(75) Inventor: Marco Ronconi, Bologna (IT)

(73) Assignee: Fasco S.p.A., Cadriano di Granarolo Emilia (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/210,565

(22) Filed: Dec. 14, 1998

(30) Foreign Application Priority Data

Jan. 9, 1998 (IT) ..... BO98A0005

(51) Int. Cl.[7] ..... B25C 1/04
(52) U.S. Cl. ..... 227/119; 227/130; 227/136
(58) Field of Search ..... 227/135, 136, 227/137, 109, 119, 120

(56) References Cited

U.S. PATENT DOCUMENTS 3,623,646 * 11/1971 Cast et al. ..... 227/136
4,319,705 * 3/1982 Geist et al. ..... 227/120
4,942,996 * 7/1990 Wolfberg et al. ..... 227/136
5,738,266 * 4/1998 Ogawa ..... 227/119
5,772,098 * 6/1998 Crutcher ..... 227/136
5,803,338 * 9/1998 Singer et al. ..... 227/136
6,032,848 3/2000 Dariusz .

FOREIGN PATENT DOCUMENTS 0 711 635 5/1996 (EP) .
0 726 122 8/1996 (EP) .
0 739 690 10/1996 (EP) .

* cited by examiner

*Primary Examiner*—Scott A. Smith
(74) *Attorney, Agent, or Firm*—Guido Modiano; Albert Josif; Daniel O'Byrne

(57) ABSTRACT

A compressed-air nail firing tool having a body, inside which a device for the actuation of a striking blade adapted to engage a firing channel is accommodated, the firing channel being formed along a tube which lies in a front region of the body, and a magazine, which is rigidly coupled to the body and is connected to the firing channel and inside which a ribbon of nails is adapted to loaded, the nails being meant to be fed individually to the firing channel, under the actuation of an advancement device which is associated with the magazine. In a region for feeding to the firing channel the nails are guided with their respective head along a slot which leads into the firing channel, permitting feeding of ribbons of nails retained by a strip of plastics or retained by soldered metal wires.

2 Claims, 4 Drawing Sheets

COMPRESSED-AIR NAIL FIRING TOOL

BACKGROUND OF THE INVENTION

The present invention relates to a compressed-air nail firing tool.

It is known to use compressed-air nail firing tools which are adapted to fire metal nails, for example for fixing wood items and the like. Said nail firing tools are substantially constituted by a body which lies above a handle which can be connected to a compressed air delivery hose; means for the actuation of a striking blade in a piston-like fashion are accommodated inside said body. The striking blade is adapted to engage a firing channel formed along a tube which protrudes from a head which is fixed in a front region to the nail firing tool body.

The nails to be fired are fed sequentially to the firing channel from a magazine which is rigidly coupled to the nail firing tool, below the tube, inside which a ribbon of nails, rolled into a reel, is loaded. The nails are mutually parallel along said ribbon on an axis which is substantially transverse to the longitudinal extension of the belt.

The nails are fed individually to the firing channel under the control of an advancement device which is associated with the magazine. In practice, the device actuates the stepwise advancement of the ribbon of nails loaded in the magazine, placing the first nail of the ribbon at the firing channel, where the nail is struck forcefully by the striking mass.

The nail ribbons used with the above described nail firing tools are currently manufactured in various ways.

In particular, in the case of roundhead nails, ribbons are known which are constituted by a strip of plastics which is shaped so as to form a series of clips which are adapted to retain the nails. As shown by way of example in FIG. 5, the nails 10 are retained by the strip 12 proximate to the respective head 11; the strip 12 forms the clips 13, which individually retain the nails 10 in two appropriately spaced points.

According to another conventional solution, the nails are mutually rigidly coupled by two thin metal wires which are soldered on one side of said nails.

The nail ribbon must be guided appropriately in the magazine of the nail firing tool, particularly at the region for feeding the nails to the firing channel formed by the tube.

For this purpose, if ribbons of nails retained by a strip of plastics are used, the magazine is provided internally for example with a slotted guide in which the strip of plastics is slidingly inserted.

If instead ribbons of nails retained by two soldered metal wires are used, the metal wires slide inside corresponding grooves formed by the magazine.

In order to use both types of nail ribbon it is therefore necessary to use suitable adaptors, such as for example removable guides to be applied to the magazine if the ribbons of nails retained by a strip of plastics are used.

This of course makes the structure of the nail firing tool more complicated, with a greater risk of breakage and abnormal operation, and also makes the nail firing tool more difficult to use if it is necessary to change the type of nail ribbon.

SUMMARY OF THE INVENTION

The aim of the present invention is to solve the cited problem by providing a compressed-air nail firing tool which allows optimum feeding of the nails to the firing channel both when using ribbons of nails retained by a strip of plastics and when using ribbons of nails retained by soldered metal wires.

Within the scope of this aim, an object of the present invention is to provide a compressed-air nail firing tool which is simple in concept, definitely reliable in operation and versatile in use.

This aim and this object are both achieved by a compressed-air nail firing tool according to the present invention, comprising: a body wherein a firing channel is defined, means for the actuation of a striking blade adapted to engage a firing channel being accommodated in said body, said firing channel being formed along a tube which lies in a front region of said body; and a magazine, which is rigidly coupled to said body and is connected to said firing channel and inside which a ribbon of nails is adapted to be loaded, said nails being meant to be fed individually to said firing channel, under the actuation of an advancement device which is associated with said magazine, characterized in that a slot, which leads into said firing channel, is defined in a region for feeding said nails to said firing channel, said nails being guided with their respective head along said slot.

BRIEF DESCRIPTION OF THE DRAWINGS

The details of the invention will become apparent from the detailed description of a preferred embodiment of the compressed-air nail firing tool, illustrated only by way of non-limitative example in the accompanying drawings, wherein.

DESCRIPTION OF THE PREFERRED EMBODIMENTS

Figure 1:
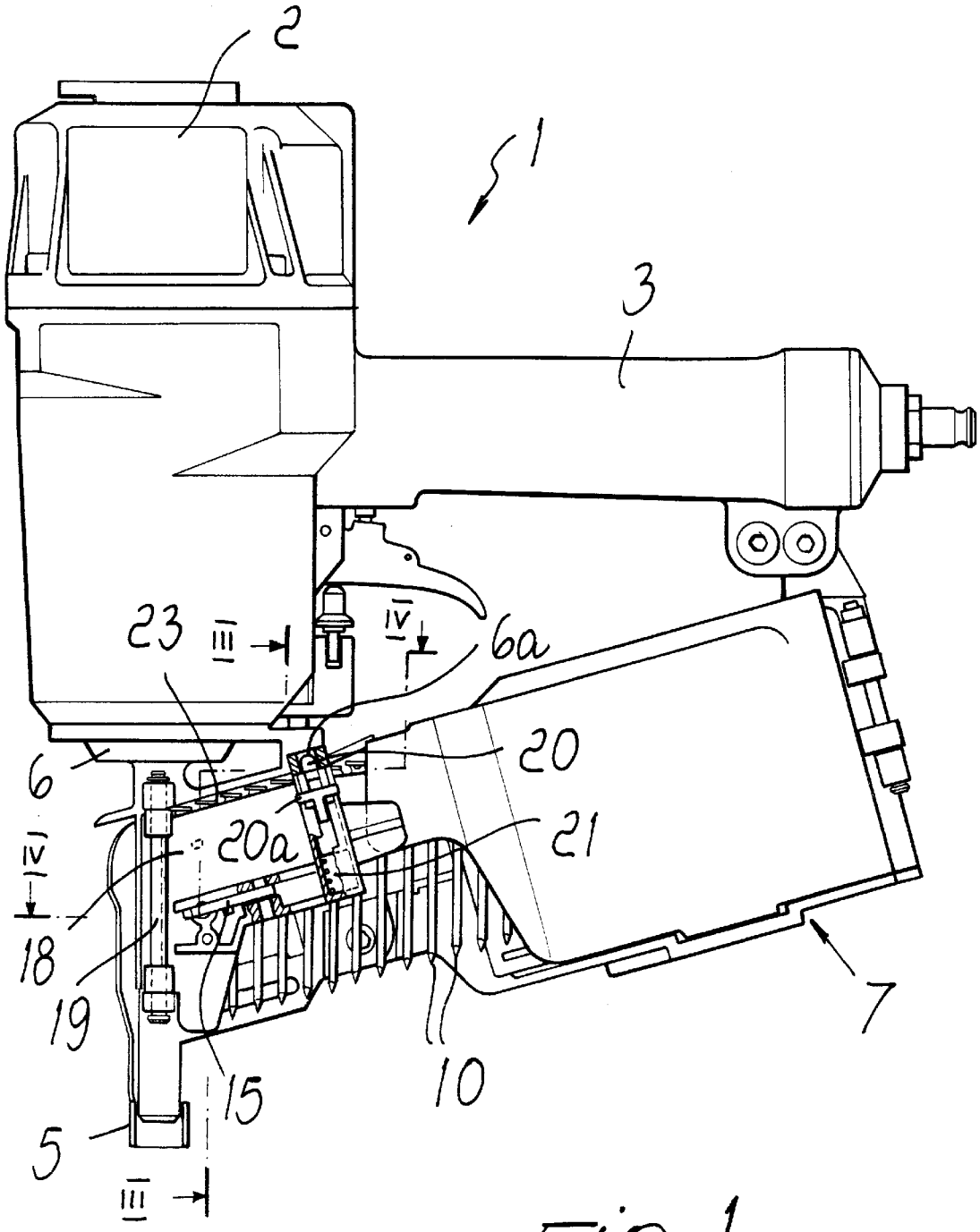
FIG. 1 is a general side view of the compressed-air nail firing tool according to the invention.
Figure 2:
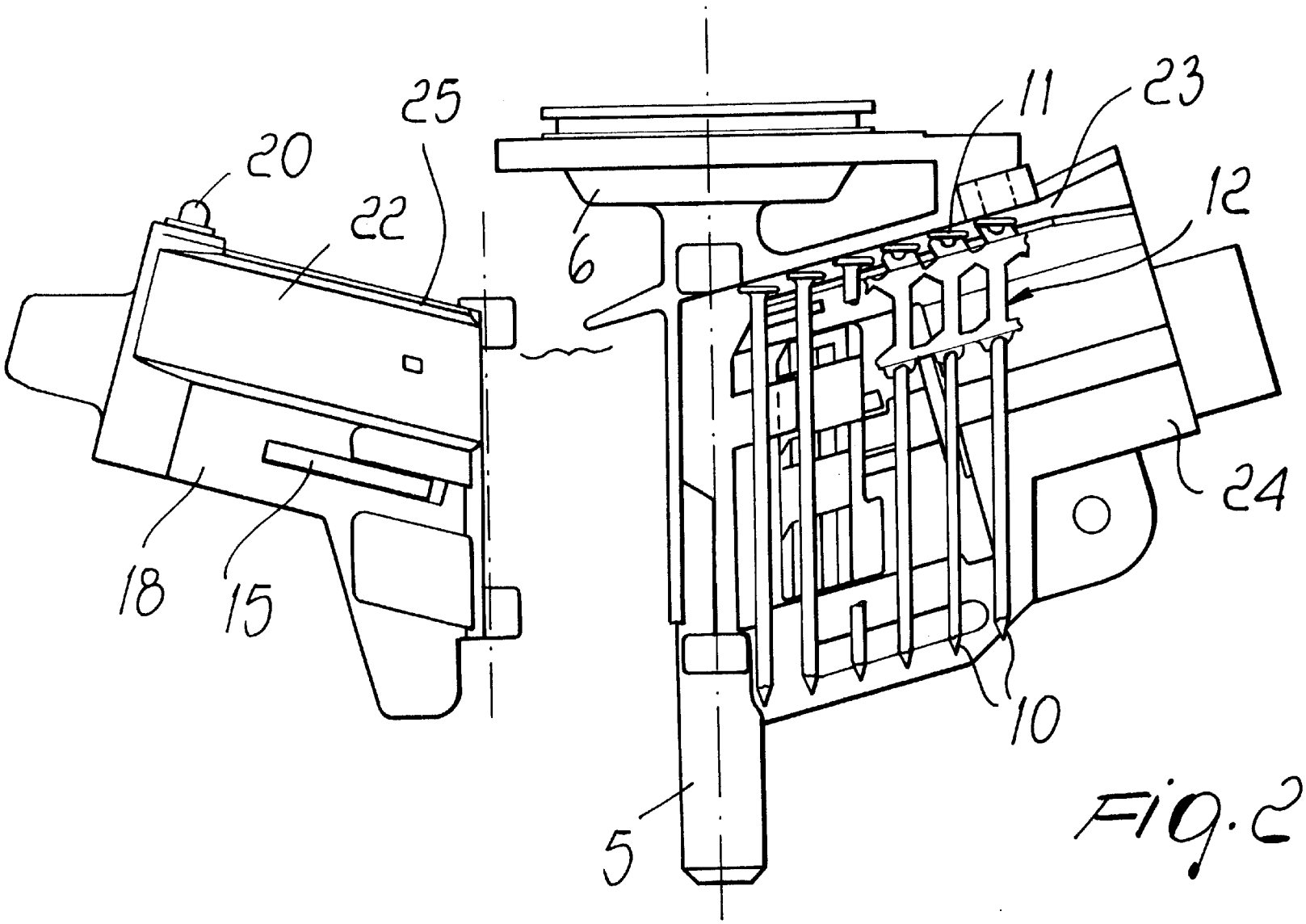
FIG. 2 is a detail side view of the region for feeding the nails into the firing channel of the nail firing tool, with the cover turned over and detached to show the internal part of said region.

With reference to the above figures, the reference numeral 1 generally designates the compressed-air nail firing tool, which is adapted to fire nails 10.

Figure 4:
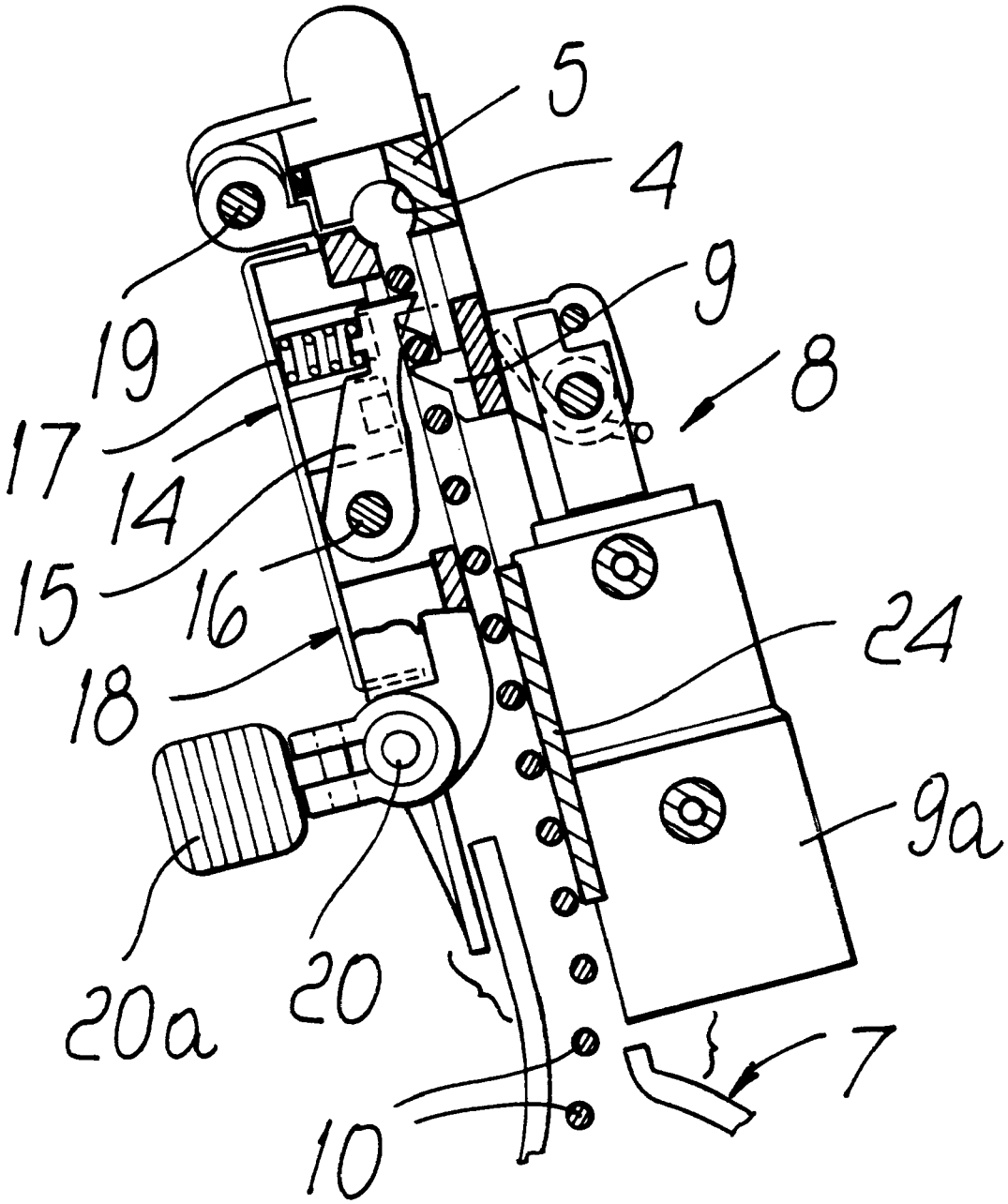

The nail firing tool 1 is constituted by a body 2 which, in a conventional manner, lies above a handle 3 which is to be connected to a compressed air delivery hose. Means, not shown, for the piston-like actuation of an adapted striking blade are accommodated inside the body 2. The striking blade is adapted to engage a firing channel 4 (see FIG. 4) formed along a tube 5 which protrudes from a head 6 fixed in a front region to the body 2 of the nail firing tool.

The nails 10 are fed to the firing channel 4 by a magazine 7 which is rigidly coupled to the nail firing tool, below the handle 3, and inside which a coiled ribbon of nails 10 is loaded.

The nails 10 are fed individually to the firing channel 4 under the actuation of a per se known advancement device 8 which is associated with the magazine 7. The advancement device 8 is provided with a ratchet system 9 which is adapted to act on the ribbon of nails 10 under the actuation of an adapted actuator 9*a* which is constituted by a pneumatic cylinder. In practice, the ratchet system 9 of the device 8 actuates the stepwise advancement of the ribbon of nails 10 loaded in the magazine 7, placing the first nail of the ribbon at the firing channel 4, where said nail is struck by the striking blade.

A stop device 14 cooperates with the advancement device 8 and is adapted to prevent the elastic return of the ribbon of nails 10. The stop device 14 is provided with a lever 15 which is hinged on a fulcrum 16, is adapted to engage the ribbon of nails 10 and is actuated elastically by a spring 17.

The stop device 14 is supported by a cover 18 which is articulated at the tube 5 of the nail firing tool by means of a pivot 19. The cover 18 can be locked in a closed position by means of a pin 20 which is guided in a seat of the cover 18 and is actuated elastically by a corresponding spring 21. The pin 20, which by means of the spring 21 is adapted to engage in a hole 6*a* of the head 6, can be disengaged by acting on a lever 20*a* which protrudes from the pin 20 through a longitudinal slot of the guiding seat.

Figure 3:
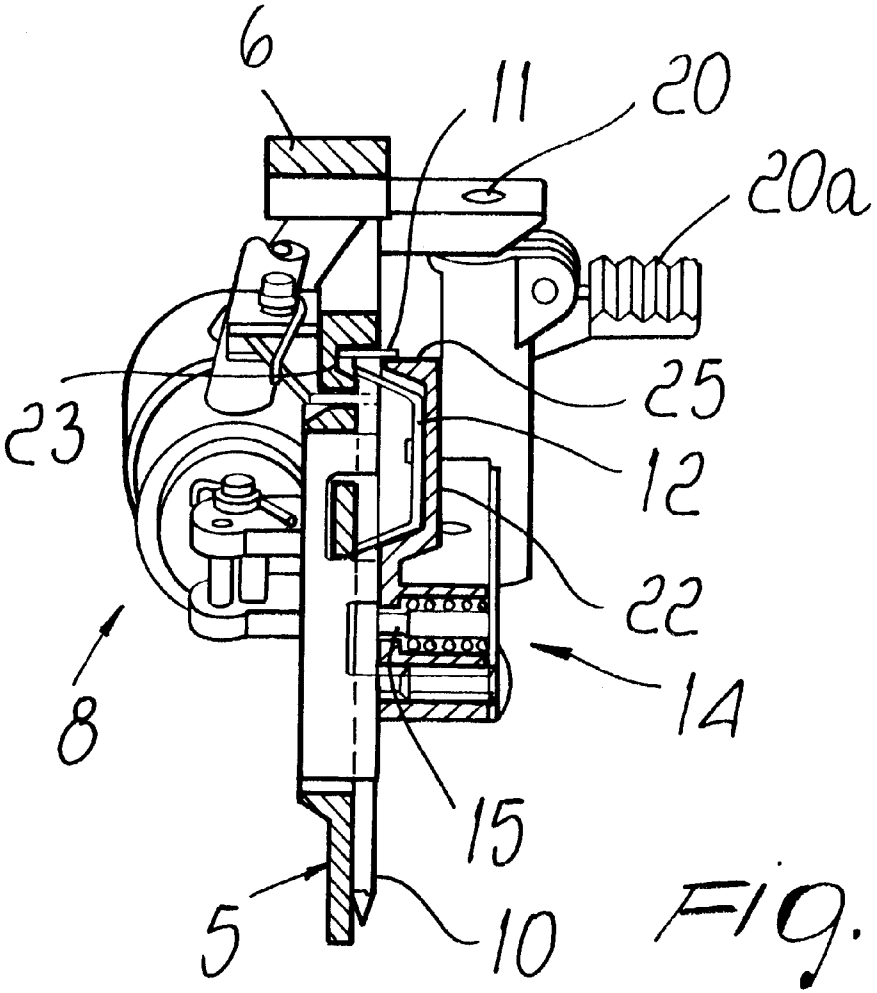
FIGS. 3 and 4 are, respectively, sectional views taken along the planes III—III and IV—IV of FIG. 1, respectively.
Figure 5:
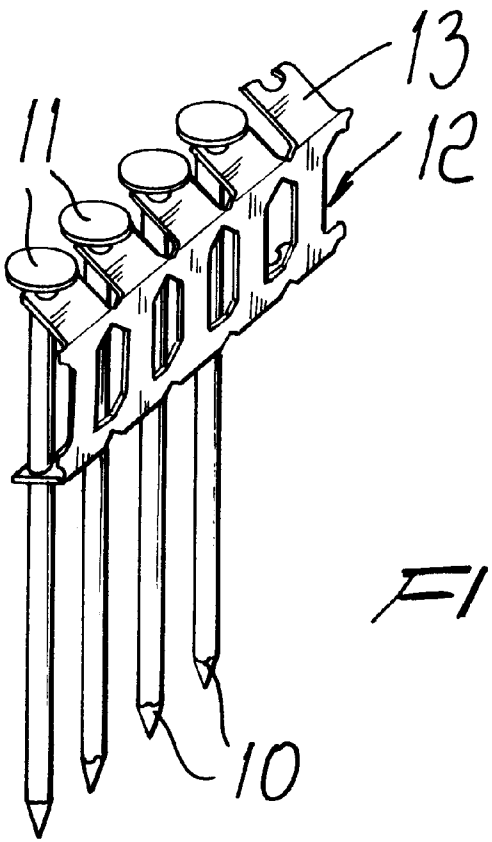
FIG. 5 is a view of a ribbon of nails.

The cover 18 forms a channel 22 which has a substantially trapezoidal profile and in which a strip 12 of plastics that retains the nails 10, as shown in particular in FIG. 3, is adapted to be guided.

During feeding to the firing channel 4, the nails 10 are guided by means of a portion of their respective head 11 along a slot 23 formed in a plate 24, on which the cover 18 closes; conveniently, the plate 24 is formed monolithically with the tube 5 of the nail firing tool.

The slot 23 leads into the firing channel 4.

The portion of the head 11 of the nails 10 that protrudes from the slot 23 on the opposite side with respect to the plate 24 is guided so as to rest on a wing 25 which shapes an edge of the cover 18 and delimits the channel 22 in an upward region (FIG. 3).

The operation of the nail firing tool is easily understandable from the above description.

The ribbon of nails 10 inserted in the magazine 7 unwinds, at the region for feeding said nails 10 to the firing channel 4, between the plate 24 and the cover 18 which is pivoted to the tube 5 and locked by means of the pin 20.

In the feeding region, the nails are guided along the slot 23 by the respective head 11, which furthermore slides so as to rest on the wing 25 of the cover 18.

This embodiment ensures correct feeding of the nails 10 into the firing channel 4, independently of the fact that the nails 10 are retained by the strip 12 of plastics or by soldered wires.

The fact should be noted in particular that this solution does not require the use of removable adaptors or the like if ribbons of nails retained by a plastic strip are used; said strip runs along the channel 22 formed by the cover 18.

The problem of providing optimum feeding of the nails to the firing channel both when using ribbons of nails retained by a strip of plastics and ribbons of nails retained by soldered metal wires is therefore solved in a simple way.

In the practical embodiment of the invention, the materials used, as well as the shapes and the dimensions, may be any according to the requirements.

The disclosures in Italian Patent Application No. BO98A000005 from which this application claims priority are incorporated herein by reference.

What is claimed is:

1. A compressed-air nail firing tool in combination with a ribbon of nails, comprising:

a body wherein a firing channel is defined, means for the actuation of a striking blade adapted to engage said firing channel being accommodated in said body, said firing channel being formed along a tube which lies in a front region of said body;

a magazine, which is rigidly coupled to said body and is connected to said firing channel and inside which said ribbon of nails is loaded;

an advancement device associated with said magazine for individually feeding the nails of said ribbon of nails to said firing channel;

a plate associated with said tube and adapted to be closed by a cover hinged at said tube, said ribbon of nails unwinding between said plate and said cover in a closed configuration;

a slot formed in said plate and leading into said firing channel, said nails of said ribbon of nails being guided with a first top portion of their respective head sliding along in engaging contact with said slot; and a wing formed on said cover and extending parallel to said slot when said cover is in said closed configuration so that said wing acts as a guiding support for a second bottom portion of the nails opposite to said first top portion slidingly engaging said slot such that said second bottom portion of the head of the nails sliding along in engaging contact with said wing when said nails are retained by a strip of plastics or by soldered wires of said ribbon of nails.

2. The nail firing tool according to claim 1, wherein said ribbon of nails comprises a plurality of nails retained on a strip of plastics and said wing defines on said cover a channel in which said strip of plastics is guided.

* * * * *